US010964500B2

(12) United States Patent
Tanaka et al.

(10) Patent No.: US 10,964,500 B2
(45) Date of Patent: Mar. 30, 2021

(54) ELECTROMAGNETIC RELAY

(71) Applicant: DENSO ELECTRONICS CORPORATION, Anjo (JP)

(72) Inventors: Tomoaki Tanaka, Anjo (JP); Makoto Kamiya, Anjo (JP)

(73) Assignee: DENSO ELECTRONICS CORPORATION, Anjo (JP)

( * ) Notice: Subject to any disclaimer, the term of this patent is extended or adjusted under 35 U.S.C. 154(b) by 392 days.

(21) Appl. No.: 15/776,284

(22) PCT Filed: Sep. 26, 2016

(86) PCT No.: PCT/JP2016/078139

§ 371 (c)(1),
(2) Date: May 15, 2018

(87) PCT Pub. No.: WO2017/086025

PCT Pub. Date: May 26, 2017

(65) Prior Publication Data

US 2020/0273650 A1 Aug. 27, 2020

(30) Foreign Application Priority Data

Nov. 17, 2015 (JP) ..... JP2015-225049

(51) Int. Cl.
*H01H 50/30* (2006.01)
*H01H 50/04* (2006.01)
*H01H 50/54* (2006.01)

(52) U.S. Cl.
CPC ..... *H01H 50/30* (2013.01); *H01H 50/045* (2013.01); *H01H 50/546* (2013.01); *H01H 2235/004* (2013.01)

(58) Field of Classification Search
CPC .... H01H 50/30; H01H 50/045; H01H 50/546; H01H 2235/004; H01H 1/50; H01H 1/54
See application file for complete search history.

(56) References Cited

U.S. PATENT DOCUMENTS 5,986,528 A * 11/1999 Meier ..... H01H 1/54 335/129
2010/0193475 A1* 8/2010 Kamiya ..... H01H 50/12 218/157

(Continued)

FOREIGN PATENT DOCUMENTS

JP 2014182943 A 9/2014
JP 2016162134 A 9/2016

*Primary Examiner* — Mohamad A Musleh
(74) *Attorney, Agent, or Firm* — Harness, Dickey & Pierce, P.L.C.

(57) ABSTRACT

An electromagnetic relay includes: an excitation coil; a movable core; a movable contactor that operates by following the movable core; a fixed contactor that is in contact with the movable contactor when the excitation coil is energized; a base that supports the fixed contactor; a fixed yoke fixed to the base; a moving yoke; a first pressing spring that biases the moving yoke toward the movable contactor; and a second pressing spring that biases the movable contactor such that the movable contactor and the fixed contactor are in contact with each other. The moving yoke is disposed to be in contact with a surface of the movable contactor opposite from the fixed contactor and to oppose the fixed yoke through the movable contactor. The moving yoke is provided to be able to contact and separate from the movable contactor.

11 Claims, 4 Drawing Sheets

(56) References Cited

U.S. PATENT DOCUMENTS

| | | | | |
|---|---|---|---|---|
| 2013/0115807 | A1* | 5/2013 | Enomoto | H01H 50/36<br>439/539 |
| 2013/0335177 | A1* | 12/2013 | Enomoto | H01H 1/20<br>335/192 |
| 2016/0293368 | A1* | 10/2016 | Tanaka | H01H 50/40 |

* cited by examiner

ELECTROMAGNETIC RELAY

CROSS REFERENCE TO RELATED APPLICATIONS

This application is a U.S. National Phase Application under 35 U.S.C. 371 of International Application No. PCT/JP2016/078139 filed on Sep. 26, 2016 and published in Japanese as WO 2017/086025 A1 on May 26, 2017. This application is based on and claims the benefit of priority from Japanese Patent Application No. 2015-225049 filed on Nov. 17, 2015. The entire disclosures of all of the above applications are incorporated herein by reference.

TECHNICAL FIELD

The present disclosure relates to an electromagnetic relay which opens or closes an electric circuit by making a movable contact and a fixed contact to contact or separate.

BACKGROUND ART

A conventional relay opens and closes an electric circuit by making a movable contact and a fixed contact to contact or separate. Specifically, a stator which has the fixed contact is fixed after the positioning. One movable element which has the movable contact is moved such that the movable contact and the fixed contact are in contact with or separated from each other. More specifically, the relay includes a movable component drawn by an electromagnetic force of a coil, a pressing spring which biases the movable element such that the fixed contact and the movable contact are in contact with each other, and a return spring which biases the movable element through the movable component such that the fixed contact and the movable contact are separated from each other.

When the coil is energized, the movable component is driven by the electromagnetic force to move away from the movable element, and the movable element is biased by the pressing spring to move, such that the fixed contact and the movable contact are in contact, while the movable component and the movable element are separated from each other (for example, refer to Patent Literature 1).

PRIOR ART LITERATURES

Patent Literature

Patent Literature 1: JP 2014-182943 A

SUMMARY OF INVENTION

In the electromagnetic relay described in Patent Literature 1, both of shock proof performance and short-circuit proof performance are required. The shock proof performance means a performance keeping that the fixed contact and the movable contact are maintained in the contact state when the electromagnetic relay receives shock such as vibration or collision in the state where the fixed contact and the movable contact are in the contact state.

FIG. 9 illustrates a state where a fixed contact and a movable contact are in contact, in the electromagnetic relay described in Patent Literature 1. In this drawing, a movable element 920, a movable yoke 930, and a movable contact 925 can be integrally moved.

The movable element 920, the movable yoke 930, and the movable contact 925 are integrally formed into a movable component. A contact pressure PP is impressed to the movable component in a direction (−Z direction) in which the movable contact 925 is made to contact a fixed contact 927 by a pressing spring 924. When a shock is impressed to the movable component in a direction (Z direction) in which the movable contact 925 separates from the fixed contact 927, an impulse force FF is impressed to the movable component. The impulse force FF is calculated by multiplying the mass m of the movable component with an acceleration G.

In order to secure the shock proof performance, it is necessary to make the contact pressure PP larger than the impulse force FF. That is, since the impulse force FF received by the movable component is proportional to the mass m of the movable component, the shock proof performance can be made advantageous by decreasing the weight m of the movable component.

If a short-circuit current flows between the movable contact and the fixed contact in such an electromagnetic relay, an electromagnetic repulsive force is generated by a flow of reverse current, in the contact part between the movable contact and the fixed contact, at a position where the movable contact and the fixed contact oppose to each other. (Hereafter, the electromagnetic repulsive force is referred to as a contact part electromagnetic repulsive force).

The contact part electromagnetic repulsive force acts such that the movable contact and the fixed contact are separated from each other. Then, the spring force of the pressing spring and the drawing force between yokes are set up so that the movable contact and the fixed contact are not separated from each other by the contact part electromagnetic repulsive force.

However, as the flowing current increases in the contact part between the movable contact and the fixed contact, the contact part electromagnetic repulsive force also becomes large. Therefore, it is necessary to increase the spring force of the pressing spring or the drawing force between yokes in accordance with increase in the current value.

That is, the short-circuit proof performance can be made advantageous by increasing the spring force of the pressing spring, or increasing the movable yoke to increase the drawing force between the movable yoke and the fixed yoke.

However, in case where the spring force of the pressing spring is increased, it is necessary to increase the spring force of a return spring. In this case, the size of the coil becomes large, and rebellion arises that the product physique becomes large as a result.

Moreover, as another rebellion, when the movable yoke is enlarged, since the weight of the movable component becomes large, there is a possibility that the shock proof performance may fall. Thus, the shock proof performance and the short-circuit proof performance have a relation of a trade-off.

It is an object of the present disclosure to provide an electromagnetic relay in which the short-circuit proof performance is improved without a lowering in the shock proof performance and without an increase in the product physique.

According to an aspect of the present disclosure, an electromagnetic relay includes: an excitation coil that forms a magnetic field at an energizing time; a movable core that is driven by an electromagnetic force of the excitation coil; a movable contactor that operates by following the movable core; a fixed contactor that is in contact with the movable contactor when the excitation coil is energized; a base that supports the fixed contactor; a fixed yoke made of magnetic body and fixed to the base; a moving yoke made of magnetic body and disposed to oppose the fixed yoke through the movable contactor and to be in contact with a surface of the movable contactor opposite from the fixed contactor; a first pressing spring that biases the moving yoke toward the movable contactor; and a second pressing spring that biases the movable contactor such that the movable contactor and the fixed contactor are in contact with each other, wherein the moving yoke is provided to be able to contact and separate from the movable contactor.

Accordingly, in case where a shock is received in a direction such that a movable contactor and a fixed contactor are separated from each other in a state where the movable contactor is in contact with the fixed contactor at a time of energizing the excitation coil, even if the moving yoke separates from the movable contactor against the first pressing spring, the state where the movable contactor and the fixed contactor are in contact with each other can be maintained, because the movable contactor is biased by the second pressing spring such that the movable contactor and the fixed contactor are in contact with each other. Therefore, for example, in case where a large and heavy moving yoke is used to raise the short-circuit proof performance, even if the moving yoke separates from the movable contactor against the first pressing spring by receiving a shock applied such that the movable contactor and the fixed contactor are separated from each other, the movable contactor is biased by the second pressing spring such that the movable contactor and the fixed contactor are in contact with each other. Accordingly, the state where the movable contactor and the fixed contactor are in contact with each other is maintained. That is, the short-circuit proof performance can be raised without a lowering in the shock proof performance and without an increase in the product physique.

Since the first pressing spring is made of a coil spring, the moving yoke can be uniformly, as a whole, biased toward the movable contactor.

The moving yoke may have at least one of a protrusion portion or a recess portion to restrain movement of the first pressing spring in the radial direction, on the surface opposite from the movable contactor.

Accordingly, the positioning of the first pressing spring can be easily performed, and the first pressing spring can be prevented from moving in the radial direction of the first pressing spring.

Since the second pressing spring is made of a coil spring, the movable contactor can be uniformly, as a whole, biased.

The movable contactor may have at least one of a protrusion portion or a recess portion to restrain movement of the second pressing spring in the radial direction, relative to the moving yoke, on the surface adjacent to the moving yoke.

Accordingly, the moving yoke can be returned to the original position when the moving yoke contacts the movable contactor, after the moving yoke is separated from the movable contactor by, for example, a shock.

The movable contactor may have at least one of a protrusion portion or a recess portion to restrain movement of the second pressing spring in the radial direction, on the surface opposite from the fixed contactor.

Accordingly, the positioning of the second pressing spring can be easily performed, and the second pressing spring can be prevented from moving in the radial direction of the second pressing spring.

The electromagnetic relay may further include a cover which has a recess portion or a protrusion portion holding at least one of an end of the first pressing spring and an end of the second pressing spring. In this case, it is possible to easily assemble at least one of the end of the first pressing spring and the end of the second pressing spring.

The first pressing spring may be fixed on the moving yoke. Thereby, the assembling nature can be improved since it is unnecessary to positioning the first pressing spring relative to the moving yoke.

The second pressing spring may be fixed on the movable contactor. Thereby, the assembling nature can be improved since it is unnecessary to positioning the second pressing spring relative to the movable contactor.

The first pressing spring may be fixed on the cover. Thereby, the assembling nature can be improved since it is unnecessary to positioning the first pressing spring relative to the cover.

The second pressing spring may be fixed on the cover. Therefore, the assembling nature can be improved since it is unnecessary to positioning the second pressing spring relative to the cover.

DESCRIPTION OF EMBODIMENTS

Figure 1:
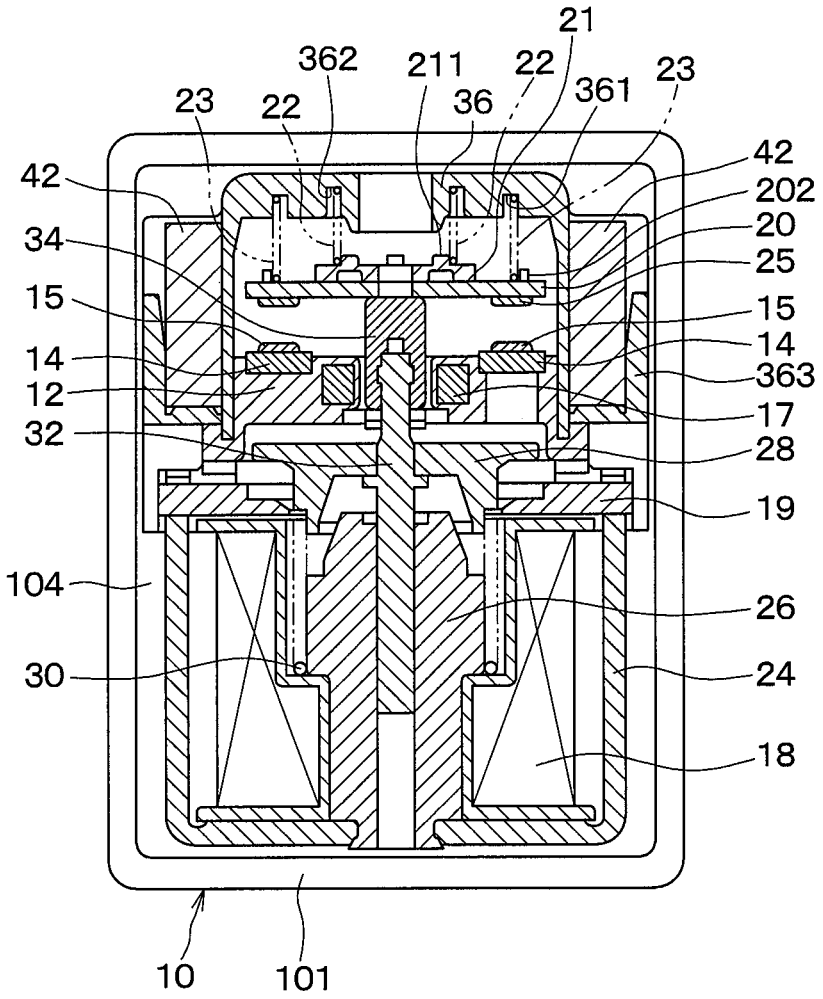
FIG. 1 is a sectional view illustrating an electromagnetic relay according to an embodiment.
Figure 2:
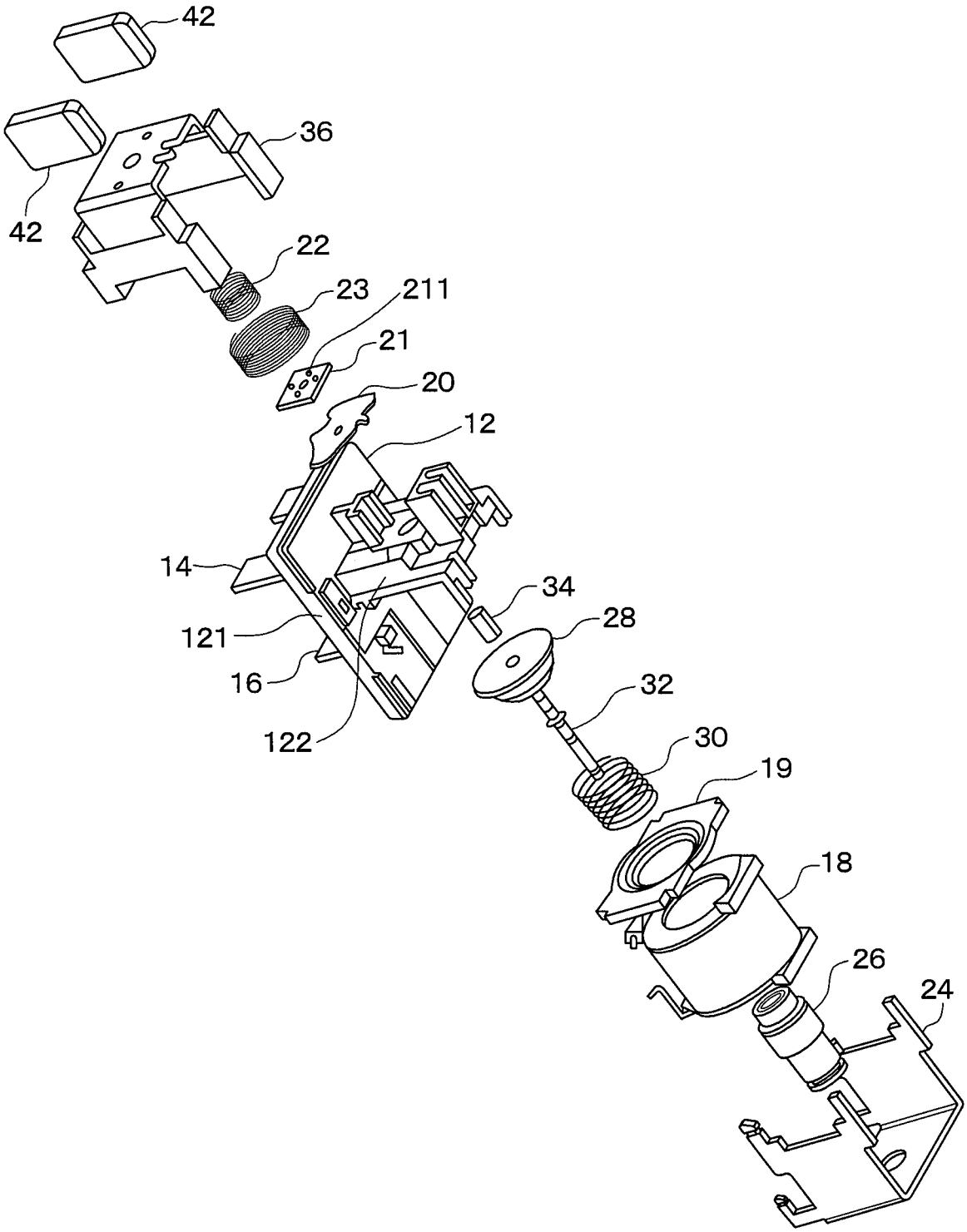
FIG. 2 is an exploded perspective view of the electromagnetic relay of the embodiment.

An electromagnetic relay according to an embodiment is explained. The electromagnetic relay of this embodiment can be used, for example, for a hybrid vehicle or an electric vehicle. FIG. 1 is a sectional view illustrating the electromagnetic relay of this embodiment. FIG. 2 is an exploded perspective view of the electromagnetic relay, in which a case 10 is omitted.

As shown in FIG. 1 and FIG. 2, the electromagnetic relay of this embodiment includes the case 10 made of resin. The case 10 is a based rectangular pipe having four case side wall parts 101 and one case bottom (surface on the back side in the sheet of FIG. 1). A case opening is defined in a side (surface on the front side in the sheet of FIG. 1) opposing the case bottom. A housing space 104 is formed inside the case 10, and the housing space 104 is opened to outside through the case opening.

A base 12 made of resin has a base bottom 121 which closes the case opening by fitting with the case 10, a base main part 122 projected from the base bottom 121 toward the case bottom, and a cover 36 holding pressing springs 22 and 23 to be mentioned later. The housing space 104 is defined by the case 10 and the base bottom 121. The base 12 is manufactured by insert molding in which a pair of stators 14 is inserted. The base bottom 121 has two terminal insertion holes (not shown) in which a pair of coil terminals 16 to be mentioned later are inserted, and the coil terminal 16 is inserted in each of the terminal insertion holes.

The pair of stators 14 made of conductive metal board material are fixed to the base 12. An end of the stator 14 is fixed to the base main part 122 and located in the housing space 104, and the other end of the stator 14 is projected outside. A fixed contact 15 made of conductive metal is fixed to the end of the stator 14 in the housing space 104. The other end of the stator 14 located outside is to be connected to an external electric circuit (not shown). The stator 14 and the fixed contact 15 configure a fixed contactor.

A cylindrical coil 18 is arranged in the housing space 104 to generate electromagnetic power at a time of being energized. The pair of coil terminals 16 made of conductive metal are connected to the coil 18. The coil 18 is an excitation coil.

The coil terminal 16 is connected to ECU (not shown) through an external harness. The coil 18 is energized through the external harness and the coil terminal 16.

A plate 19 shaped in a board and made of ferromagnetic substance metal material is arranged on the coil 18 adjacent to the base main part 122. A yoke 24 made of ferromagnetic substance metal material is arranged around the outer circumference of the coil 18 and a side of the coil 18 opposite from the base main part.

A cylindrical fixed core 26 made of ferromagnetic substance metal material is arranged in the inner circumference space of the coil 18.

A movable core 28 having a disk shape and made of ferromagnetic substance metal material is arranged between the base main part 122 and the plate 19. A return spring 30 is arranged between the coil 18 and the movable core 28 to bias the movable core 28 away from the fixed core.

The coil 18 generates the electromagnetic power when the coil 18 is energized, and the movable core 28 is attracted toward the fixed core 26 against the return spring 30. The plate 19, the yoke 24, the fixed core 26, and the movable core 28 define a magnetic path of magnetic flux induced by the coil 18.

A metal shaft 32 is fixed to the movable core 28 to pass through. The shaft 32 extends away from the fixed core, and an insulator 34 made of resin having excellent electrical insulation properties is fixed to the end of the shaft 32 by fitting. The other end of the shaft 32 is slidably inserted in the fixed core 26.

A movable element 20 made of conductive metal (for example, copper) and shaped in a board is positioned in the housing space 104. The movable element 20 has two movable contacts 25 made of conductive metal. Specifically, the two movable contacts 25 are fixed to the movable element 20 at the positions opposing the two fixed contacts 15. The movable element 20 and the movable contact 25 configure a movable contactor. In addition, the movable element 20 and the movable contact 25 operate by following the movable core 28 from the state where the movable contact 25 and the fixed contact 15 are separated from each other until the movable contact 25 and the fixed contact 15 are made in contact with each other.

A moving yoke 21 made of ferromagnetic substance metal material (for example, iron) is arranged on the surface of the movable element 20 opposite from the fixed contactor, i.e., on the surface of the movable element 20 adjacent to the cover 36. The moving yoke 21 is arranged to contact the surface of the movable element 20 opposite from the fixed contactor, and to oppose the fixed yoke 17 through the movable contactor. The moving yoke 21 and the movable element 20 are produced separately from each other, and are provided to be able to contact with and separate from each other.

The pressing spring 23 which biases the movable element 20 toward the fixed contactor is arranged between the movable element 20 and the cover 36. The pressing spring 23 is a second pressing spring which biases the movable element 20 toward the fixed contactor. The pressing spring 23 is a coil spring.

At least one protrusion portion 202 projected toward the cover 36 is formed on the surface of the movable element 20 adjacent to the cover 36. The protrusion portion 202 restrains movement of the pressing spring 23 in the radial direction relative to the moving yoke 21.

The pressing spring 22 which biases the moving yoke 21 toward the movable element 20 is arranged between the moving yoke 21 and the cover 36. The pressing spring 22 is a first pressing spring which biases the moving yoke 21 toward the movable element 20. The pressing spring 22 is a coil spring.

At least one protrusion portion 211 is formed on the surface of the moving yoke 21 opposite from the movable contactor, i.e., on the surface of the moving yoke 21 adjacent to the cover 36. The protrusion portion 211 restrains movement of the pressing spring 22 in the radial direction.

Two circular recess portions 361 and 362 are formed in the surface of the cover 36 adjacent to the movable element 20. The recess portion 361 holds and fixes the end of the coil-shaped pressing spring 23, and the recess portion 362 holds and fixes the end of the coil-shaped pressing spring 22.

A pair of permanent magnets 42 is arranged in a recess portion 363 of the cover 36 to form a magnetic field in a contact and separate part in which the fixed contact 15 and the movable contact 25 contact and separate from each other, such that an arc generated between the fixed contact 15 and the movable contact 25 is extended. The permanent magnets 42 are arranged to oppose each other along an arrangement direction in which a pair of the contact and separate parts are arranged (in the left-and-right direction of FIG. 3).

Figure 3:
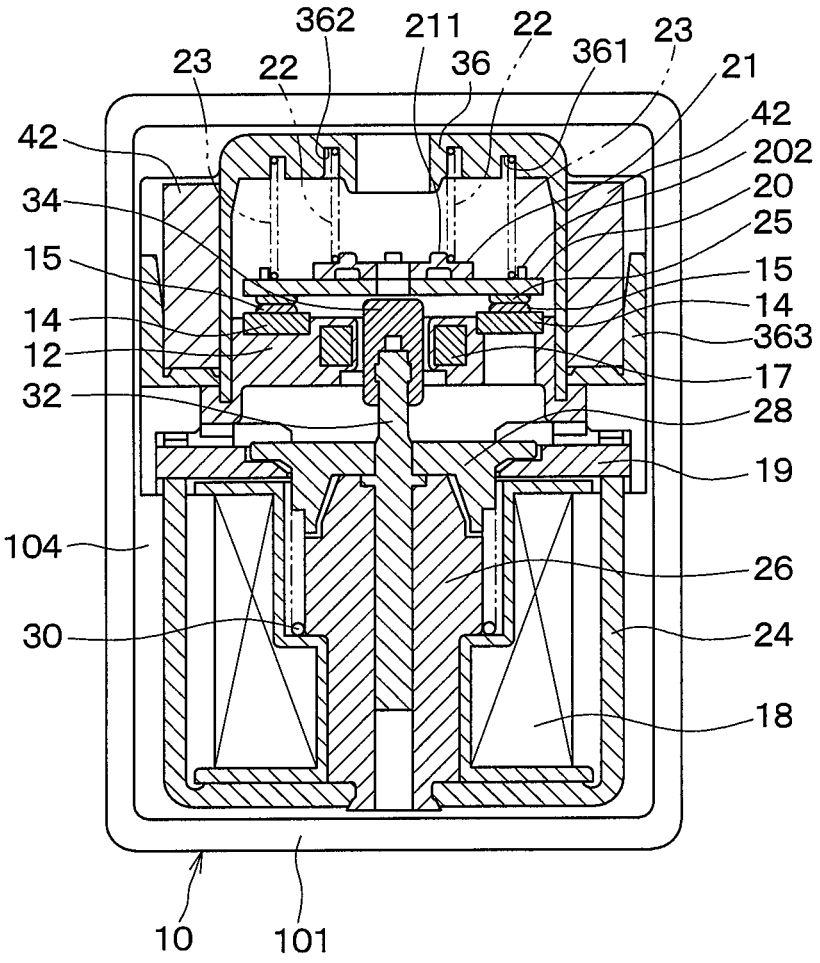
FIG. 3 is a sectional view illustrating the electromagnetic relay in which a movable core is drawn toward a fixed core against a return spring.

Next, the operation of the electromagnetic relay of this embodiment is explained. First, when the coil 18 is energized, the movable core 28 is attracted toward the fixed core 26 by the electromagnetic force against the return spring 30. As shown in FIG. 3, the movable element 20 and the moving yoke 21 are biased by the pressing springs 22 and 23, and are moved by following the movable core 28. Thereby, the movable contact 25 is in contact with the fixed contact 15, and an electrical connection is made between the pair of stators 14.

When the pair of fixed contacts 15 are electrically connected such that current flows in the movable element 20, a magnetic flux occurs about the axis of the movable element 20. The magnetic flux causes a yoke drawing power between the moving yoke 21 and the fixed yoke 17, and the moving yoke 21 biases the movable element 20 toward the fixed contact 15 due to the yoke drawing power. Therefore, the yoke drawing power prevents the contact parts from separating from each other by the electromagnetic repulsive force between the points of contact.

When the electric power supply to the coil 18 is intercepted, the return spring 30 biases the movable core 28 and the movable element 20 away from the fixed core against the pressing springs 22 and 23. Thereby, as shown in FIG. 1, the movable contact 25 is separated from the fixed contact 15, and the electrical connection between the pair of stators 14 is intercepted.

Figure 4:
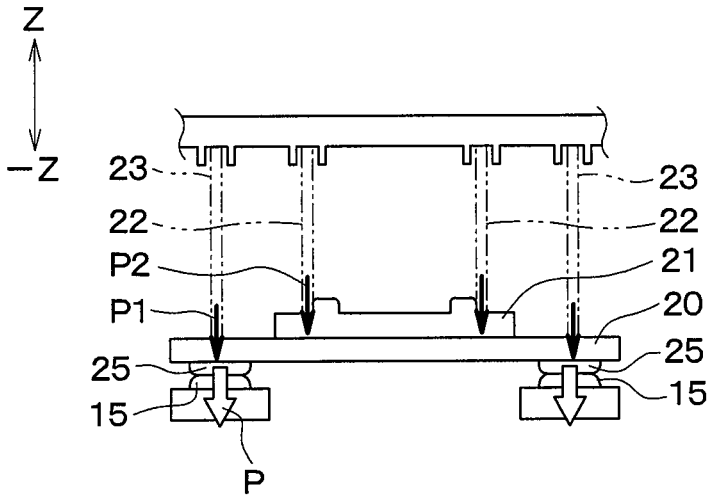
FIG. 4 is a view for explaining a contact pressure when a movable contactor is in contact with a fixed contactor.

Here, with reference to FIG. 4, a contact pressure P is explained when the movable contact 25 makes a contact to the fixed contact 15 while the movable element 20 is biased by the pressing spring 23 and while the moving yoke 21 is biased by the pressing spring 22. In FIG. 4, the movable contact 25 separates from the fixed contact 15 in an arrow direction Z.

The movable element 20 is biased in the −Z direction by the pressing spring 23. The moving yoke 21 is biased in the −Z direction by the pressing spring 22. That is, the moving yoke 21 is pressed against the movable element 20 by the pressing spring 22.

When a force of the pressing spring 23 biasing the movable element 20 in the −Z direction is defined by P1, and when a force of the pressing spring 22 biasing the moving yoke 21 in the −Z direction is defined by P2, the contact pressure P applied between the movable contact 25 and the fixed contact 15 can be expressed as P=P1+P2. In addition, the force P2 of the pressing spring 22 biasing the moving yoke 21 in the −Z direction is set only for suppressing the moving yoke 21 not to separate from the movable element 20.

Figure 5:
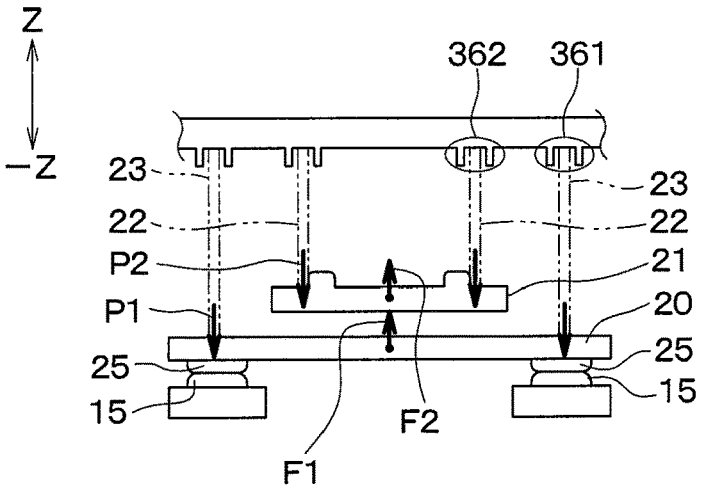
FIG. 5 is a view illustrating a situation where an impulse force is impressed in a direction in which the movable contactor separates from the fixed contactor.

FIG. 5 illustrates a situation where an impulse force F of an acceleration G is impressed in the direction (the Z direction) such that the movable contact 25 separates from the fixed contact 15. As shown in FIG. 5, an impulse force impressed to the movable element 20 in the Z direction is defined by F1, and an impulse force impressed to the moving yoke 21 in the Z direction is defined by F2. Moreover, the force of the pressing spring 23 biasing the movable element 20 in the −Z direction is defined as P1, and the force of the pressing spring 22 biasing the moving yoke 21 in the −Z direction is defined as P2.

If a relation of F2>P2 is met, the moving yoke 21 moves in the Z direction and separates from the movable element 20, since the moving yoke 21 and the movable element 20 are provided to able to contact and separate from. If a relation of F1<P1 is met, the movable contact 25 is not separated from the fixed contact 15.

In the configuration of the electromagnetic relay of this embodiment, the shock proof performance is not related to the magnitudes of the impulse force F2 impressed to the moving yoke 21 in the Z direction and the force P2 of the pressing spring 22 biasing the moving yoke 21 in the −Z direction. The shock proof performance is decided by the magnitudes of the impulse force F1 impressed to the movable element 20 in the Z direction and the force P1 of the pressing spring 23 biasing the movable element 20 in the −Z direction. Therefore, the shock proof performance is not affected even if the large and heavy moving yoke is used.

Therefore, for example, even in case where the large and heavy moving yoke is used in order to make the short-circuit proof performance advantageous, when a shock is received in a direction in which the movable contact and the fixed contact are separated from each other, the moving yoke separates from the movable contact against the first pressing spring, and the movable contact is biased by the second pressing spring in a direction in which the movable contact and the fixed contact are in contact with each other. Thus, the state where the movable contact and the fixed contact are in contact is maintained. Moreover, the short-circuit proof performance can also be made advantageous, since the moving yoke can be enlarged to increase the drawing power between the moving yoke and the fixed yoke.

The electromagnetic relay includes the coil 18 that forms a magnetic field at an energizing time, the movable core 28 driven by an electromagnetic force of the coil 18, the movable contactor that operates by following the movable core 28, a fixed contactor that is in contact with the movable contactor when the coil 18 is energized, and the base 12 that supports the fixed contactor. The electromagnetic relay further includes the fixed yoke 17 made of magnetic body and fixed to the base 12, and the moving yoke 21 made of magnetic body and disposed to oppose the fixed yoke 17 through the movable contactor and to be in contact with a surface of the movable contactor opposite from the fixed contactor. The electromagnetic relay further includes the first pressing spring 22 that biases the moving yoke 21 toward the movable contactor, and the second pressing spring 23 that biases the movable contactor such that the movable contactor and the fixed contactor are in contact with each other. The moving yoke 21 is provided to be able to contact and separate from the movable contactor.

Accordingly, in case where a shock is received in a direction such that a movable contactor and a fixed contactor are separated from each other in a state where the movable contactor is in contact with the fixed contactor at a time of energizing the coil 18, even if the moving yoke 21 separates from the movable contactor against the first pressing spring 22, the state where the movable contactor and the fixed contactor are in contact with each other can be maintained, because the movable contactor is biased by the second pressing spring 23 such that the movable contactor and the fixed contactor are in contact with each other.

Therefore, for example, in case where a large and heavy moving yoke is used to raise the short-circuit proof performance, even if the moving yoke 21 separates from the movable contactor against the first pressing spring 22 by receiving a shock such that the movable contactor and the fixed contactor are separated from each other, the movable contactor is biased by the second pressing spring such that the movable contactor and the fixed contactor are in contact with each other. Accordingly, the state where the movable contactor and the fixed contactor are in contact is maintained. That is, the short-circuit proof performance can be raised without a lowering in the shock proof performance and without an increase in the product physique.

Moreover, the pressing spring 22 is a coil spring. Therefore, the pressing spring 22 can bias the moving yoke 21 uniformly as a whole, toward the movable contactor.

Moreover, since the surface of the moving yoke 21 opposite from the movable contactor has the protrusion portion 211 which restrains movement of the pressing spring 22 in the radial direction, the positioning of the pressing spring 22 can be easily conducted. Furthermore, the pressing spring 22 can be prevented from moving in the radial direction of the pressing spring 22.

Moreover, the pressing spring 23 is a coil spring. Therefore, the pressing spring 23 can bias the movable contactor uniformly as a whole.

Moreover, the surface of the movable contactor adjacent to the moving yoke 21 has the protrusion portion 201 which restrains movement of the pressing spring 23 in the radial direction relative to the moving yoke 21. Therefore, for example when the moving yoke 21 makes a contact to the movable contactor after the moving yoke 21 separates from the movable contactor, the moving yoke 21 can be returned to the original position.

Moreover, the electromagnetic relay includes the cover 36 having the recess portions 361 and 362 respectively holding the end of the pressing spring 22 and the end of the pressing spring 23. Therefore, at least one of the end of the pressing spring 22 and the end of the pressing spring 23 can be easily assembled.

Other Embodiment (1) The fixed contact 15 is produced separately and is fixed to the stator 14 by crimping in the embodiment.

Alternatively, the stator 14 may be formed in a press processing to have a projection part projected toward the movable element 20, and the projection part may be used as a fixed contact.

Similarly, the movable contact 25 is produced separately and is fixed to the movable element 20 by crimping in the embodiment. Alternatively, the movable element 20 may be formed in a press processing to have a projection part projected toward the stator 14, and the projection part may be used as a movable contact.

(2) The fixed contact 15 is fixed to the stator 14 by crimping as a projection part projected toward the movable element 20 in the embodiment. Alternatively, the stator 14 may not have the projection part projected toward the movable element 20.

Similarly, the movable contact 25 is fixed to the movable element 20 as a projection part projected toward the stator 14 in the embodiment. Alternatively, the movable element 20 may not have the projection part projected toward the stator 14.

Figure 6:
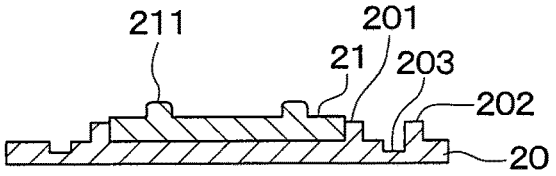
FIG. 6 is a view illustrating a modification.

(3) The protrusion portion 202 which restrains movement of the pressing spring 23 in the radial direction is formed on the surface of the movable element 20 adjacent to the cover 36 in the embodiment. Furthermore, as shown in FIG. 6, a protrusion portion 201 which restrains movement of the pressing spring 23 in the radial direction relative to the moving yoke 21 may be formed on the surface of the movable element 20 adjacent to the cover 36. Thereby, the moving yoke 21 can be positioned easily. Furthermore, the moving yoke 21 can be prevented from moving in the radial direction of the pressing spring 22. Moreover, a recess portion 203 which restrains movement of the pressing spring 23 in the radial direction may be formed on the surface of the movable element 20 adjacent to the cover 36. Moreover, although not illustrated, a recess portion which restrains movement of the pressing spring 23 in the radial direction relative to the moving yoke may be formed on the surface of the movable element 20 adjacent to the cover 36.

Figure 7:
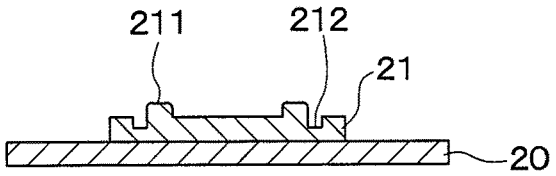
FIG. 7 is a view illustrating a modification.

(4) The protrusion portion 211 which restrains movement of the pressing spring 22 in the radial direction is formed on the surface of the moving yoke 21 adjacent to the cover 36 in the embodiment. As shown in FIG. 7, a recess portion 212 which restrains movement of the pressing spring 22 in the radial direction may be further formed on the surface of the moving yoke 21 adjacent to the cover 36 so as to restrain movement of the pressing spring 22 in the radial direction. Moreover, the recess portion 212 may be formed instead of the protrusion portion 211.

Figure 8:
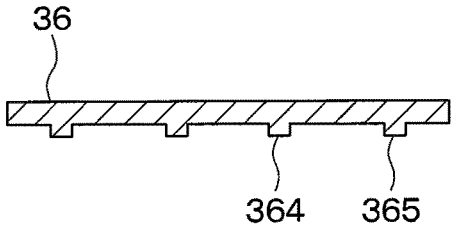
FIG. 8 is a view illustrating a modification.
Figure 9:
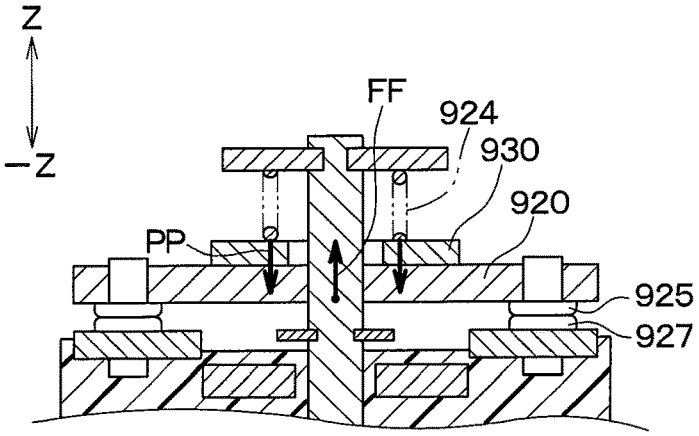
FIG. 9 is a view for explaining a subject to be solved.

(5) The recess portion 361 holding the end of the pressing spring 23 and the recess portion 362 holding the end of the pressing spring 22 are formed on the surface of the cover 36 adjacent to the movable element 20 in the embodiment. As shown in FIG. 8, a protrusion portion 365 and a protrusion portion 364 projected toward the movable element 20 may be formed on the surface of the cover 36 adjacent to the movable element 20. The end of the pressing spring 23 is positioned by the protrusion portion 365, and the end of the pressing spring 22 is positioned by the protrusion portion 364.

(6) The pressing spring 22 and the pressing spring 23 are configured as coil springs in the embodiment. Alternatively, at least one of the pressing spring 22 and the pressing spring 23 may be produced by a spring component other than the coil spring.

(7) In the embodiment, the pressing spring 22 may be fixed onto the moving yoke 21 in advance. Since the positioning of the pressing spring 23 to the moving yoke 21 becomes unnecessary, the assembling nature can be improved.

(8) In the embodiment, the pressing spring 23 may be fixed onto the movable contactor in advance. Since the positioning of the second pressing spring to the movable contactor becomes unnecessary, the assembling nature of the movable contactor can be improved.

(9) In the embodiment, the pressing spring 22 may be fixed onto the cover 36 in advance. Since the positioning of the pressing spring 22 to the cover 36 becomes unnecessary, the assembling nature can be improved.

(10) In the embodiment, the pressing spring 23 may be fixed onto the cover 36 in advance. Since the positioning of the pressing spring 23 to the cover 36 becomes unnecessary, the assembling nature can be improved.

The present disclosure is not limited to the above embodiment, and can be suitably changed within a range of the appended claims. In the respective embodiments above, it goes without saying that elements forming the embodiments are not necessarily essential unless specified as being essential or deemed as being apparently essential in principle. In a case where a reference is made to the components of the respective embodiments as to numerical values, such as the number, values, amounts, and ranges, the components are not limited to the numerical values unless specified as being essential or deemed as being apparently essential in principle. Also, in a case where a reference is made to the components of the respective embodiments above as to shapes and positional relations, the components are not limited to the shapes and the positional relations unless explicitly specified or limited to particular shapes and positional relations in principle.

What is claimed is:

1. An electromagnetic relay comprising:

an excitation coil that forms a magnetic field at an energizing time;

a movable core that is driven by an electromagnetic force of the excitation coil;

a movable contactor that operates by following the movable core;

a fixed contactor that is in contact with the movable contactor when the excitation coil is energized;

a base that supports the fixed contactor;

a fixed yoke made of magnetic body and fixed to the base;

a moving yoke made of magnetic body and disposed to oppose the fixed yoke through the movable contactor and to be in contact with a surface of the movable contactor opposite from the fixed contactor;

a first pressing spring that biases the moving yoke toward the movable contactor; and a second pressing spring that biases the movable contactor such that the movable contactor and the fixed contactor are in contact with each other, wherein the moving yoke is provided to be able to contact and separate from the movable contactor.

2. The electromagnetic relay according to claim 1, wherein the first pressing spring is a coil spring.

3. The electromagnetic relay according to claim 2, wherein the moving yoke has at least one of a protrusion portion or a recess portion on a surface of the moving yoke opposite from the movable contactor so as to restrain movement of the first pressing spring in a radial direction.

4. The electromagnetic relay according to claim 1, wherein the second pressing spring is a coil spring.

5. The electromagnetic relay according to claim 4, wherein the movable contactor has at least one of a protrusion portion or a recess portion on a surface of the movable contactor adjacent to the moving yoke so as to restrain movement of the second pressing spring in a radial direction.

6. The electromagnetic relay according to claim 4, wherein the movable contactor has at least one of a protrusion portion or a recess portion on a surface of the movable contactor opposite from the fixed contactor so as to restrain movement of the second pressing spring in a radial direction.

7. The electromagnetic relay according to claim 1, further comprising:

a cover having a recess portion or a protrusion portion that holds at least one of an end of the first pressing spring and an end of the second pressing spring.

8. The electromagnetic relay according to claim 1, wherein the first pressing spring is fixed on the moving yoke.

9. The electromagnetic relay according to claim 1, wherein the second pressing spring is fixed on the movable contactor.

10. The electromagnetic relay according to claim 7, wherein the first pressing spring is fixed on the cover.

11. The electromagnetic relay according to claim 7, wherein the second pressing spring is fixed on the cover.

* * * * *